US005185935A

United States Patent [19]

McMillion et al.

[11] Patent Number: 5,185,935

[45] Date of Patent: Feb. 16, 1993

[54] METHOD AND APPARATUS FOR SEPARATION MEASUREMENT AND ALIGNMENT SYSTEM

[75] Inventors: Michael B. McMillion, Morgantown, W. Va.; Thomas R. Miller, Waynesburg, Pa.; Terry L. Koontz, Bridgeport, W. Va.

[73] Assignee: Consolidation Coal Company, Pittsburgh, Pa.

[21] Appl. No.: 728,485

[22] Filed: Jul. 11, 1991

[51] Int. Cl.[5] ..... B65G 43/00; B65G 41/00; B60D 1/14

[52] U.S. Cl. ..... 33/1 PT; 33/755; 33/534; 33/548; 198/301; 299/1.05

[58] Field of Search ..... 33/1 PT, 263 264, 285, 33/286, 732, 733, 743, 755, 756, 759, 760, 701, 534, 548; 116/28 R; 299/1; 198/301; 280/400; 1/411.1

[56] References Cited

U.S. PATENT DOCUMENTS

| | | | |
|---|---|---|---|
| 2,334,009 | 11/1943 | Jeffrey | 299/1 |
| 2,886,299 | 5/1959 | Heimaster et al. | 299/1 |
| 3,422,949 | 1/1969 | Bankauf et al. | 198/301 |
| 4,093,309 | 6/1978 | Mullins | 299/1 |
| 4,205,453 | 6/1980 | Steele | 33/1 PT |
| 4,260,191 | 4/1981 | Weber | 299/1 |
| 4,261,617 | 4/1981 | Dröscher et al. | 299/1 |
| 4,773,520 | 9/1988 | Doerr et al. | 198/301 |
| 4,779,212 | 10/1988 | Levy | 33/755 |
| 4,824,135 | 4/1989 | McGregor | 280/400 |

*Primary Examiner*—William A. Cuchlinski, Jr.
*Assistant Examiner*—C. W. Fulton
*Attorney, Agent, or Firm*—Alan N. McCartney

[57] ABSTRACT

The method and apparatus for controlling the displacement of a steerable driven trailing machine with respect to a leading machine by measuring the separation between the machines and inputting such measurement to the trailing machine drive control, and measuring the angular disposition of the trailing machine and inputting the steering control of the trailing machine.

7 Claims, 3 Drawing Sheets

METHOD AND APPARATUS FOR SEPARATION MEASUREMENT AND ALIGNMENT SYSTEM

BACKGROUND OF THE INVENTION

1. Field of the Invention

This invention relates to a system which measures the spacing or separation between a leading and a trailing machine and also activates a control of the trailing machine to maintain the trailing machine in alignment with the leading machine.

2. Summary of the Prior Art

In a mining scheme, it is desirable to know the spacing between a continuous miner and a trailing tramming conveyor and also to maintain the receiving end of the tramming conveyor in alignment with the conveyor boom of the miner. U.S. Pat. No. 4,260,191 discloses apparatus for controlling the tension of a trailing cable for a mining machine with means to measure the distance between a cable trolley and the miner. U.S. Pat. No. 2,886,299 discloses a mechanism for measuring the angle between a trailing conveyor and a miner. U.S. Pat. No. 3,422,949 discloses an apparatus to automatically control alignment of a bridge conveyor.

SUMMARY OF THE INVENTION

It is the purpose of this invention to provide an apparatus that measures the separation between a leading and a trailing machine and activates the drive to the trailing machine in response to the measurement and, measures the angular disposition of the trailing machine and activates the steering control on the trailing machine to maintain the machines in alignment.

This invention provides apparatus to measure the distance of separation between the continuous miner and tramming conveyor for a mining system. It also provides a means of control for steering the tramming conveyor behind the miner. This could be applied to any two machines where separation distance must be automatically controlled and the trailing machine in free 3-D spaced relationship must guide itself behind the leading machine.

For distance separation measurement, this device employs a small wire rope wrapped around a spring loaded spool. With the spool assembly mounted on one machine, the free end of the wire is reeled out and attached to the second machine. The spring loaded spool keeps the wire taut as the two machines move in relation to one another. An encoder is attached to the spool shaft and determines the rotational position on the spool as the wire traverses in and out. The output from the encoder is calibrated to represent the separation between the machines.

To provide steering control for the tramming conveyor, the spring tensioned wire rope from the distance resolver is attached to an angular position detector (steering box) on the front of the tramming conveyor. Whenever the miner moves right or left, the wire rope between the miner and tramming conveyor makes an angular position change with respect to the machine frames. This change in angular position causes the steering control on the tramming conveyor to turn the front pan to maintain an aligned relation between the front pan on the tramming conveyor and the wire rope. In effect, the front of the tramming conveyor always tries to steer toward the rear center of the miner, thus providing automatic steering for the tramming conveyor.

This device was employed because its performance is not affected by airborne dust or debris. It is rugged, reliable, and easily maintained and calibrated. The ultrasonic, infrared and microwave based techniques for measuring distance were either undeveloped for this application, made inoperable by airborne dust or not cost effective.

DESCRIPTION OF THE PREFERRED EMBODIMENT

This invention environment of a continuous miner and a trailing tramming conveyor however, it must be appreciated that it can be utilized in any application wherein it is desirable to know the spacing between a leading and a trailing machine and to maintain the trailing machine in a desired position with respect to the leading machine.

Figure 1:
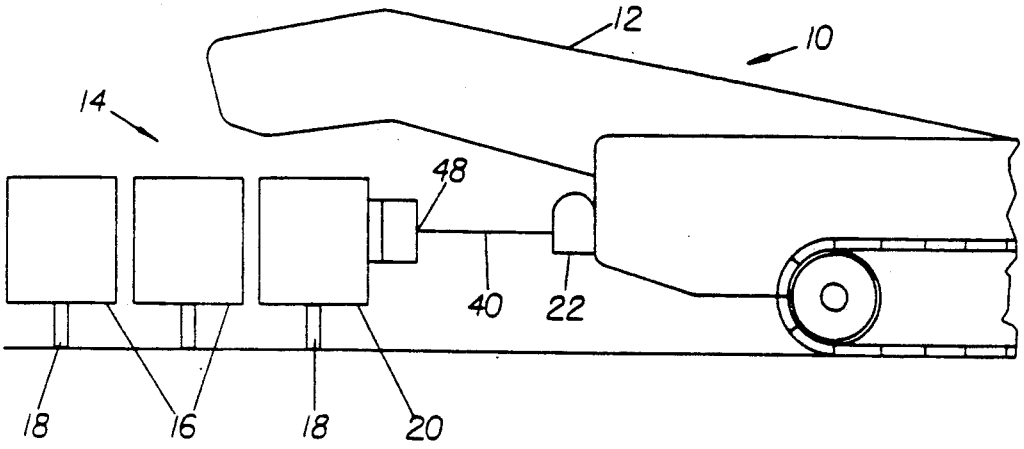
FIG. 1 is a diagrammatic illustration of the miner and the tramming conveyor.
Figure 2:
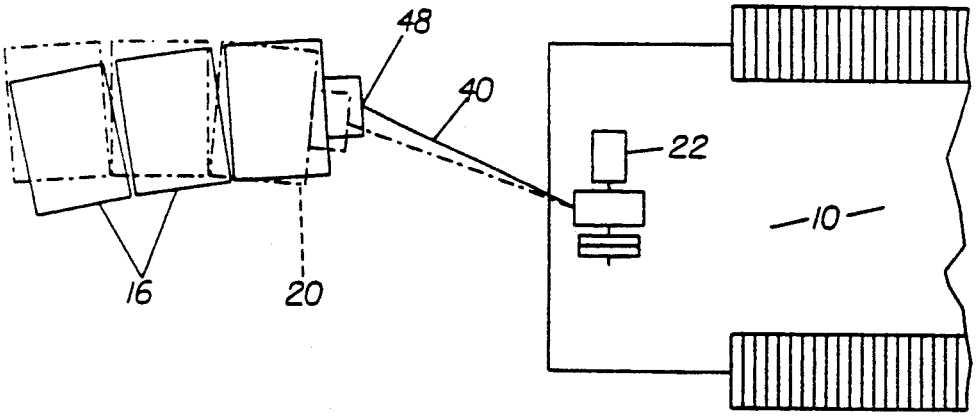
FIG. 2 is a diagrammatic bottom plan view of the miner and tramming conveyor illustrating the alignment maintenance feature.

Attention is directed to FIGS. 1 and 2 which diagrammatically illustrate a continuous miner 10 having a conveyor boom 12 which passes mined material onto the tramming conveyor 14. The tramming conveyor is disclosed in commonly owned U.S. Pat. No. 4,773,520 and the disclosure therein is incorporated herein by reference. The tramming conveyor 14 compresses a plurality of pivotally interconnected pans 16 which support a driven chain (not shown) carrying flights (not shown). The pans have jacks 18 which in the lowered position (see FIG. 1) permit the chain flights to transport material and in raised position permit the chain flights to tram along the surface to move the entire conveyor.

In the normal mining sequence, the miner advances into the mine face with the mined material being deposited onto the tramming conveyor from the boom 12. As the miner advances, it is desirable to know the spacing of the miner from the tramming conveyor to determine when the conveyor should be lowered and trammed toward the miner to maintain the end of the boom above the material input end 20 of the tramming conveyor. Also, as the miner advances it is desirable to maintain the boom 12 vertically above the material input end of the tramming conveyor, and to automatically activate the steering mechanism on the conveyor input end 20 to maintain the conveyor input end in alignment with the miner and under the boom. To accomplish these functions, this invention provides an automatic input to the control of the tramming conveyor to signal the spacing from the miner and automatically trigger conveyor move-up, as well as automatic input to the steering control on the conveyor input section to maintain alignment of the conveyor and miner (see FIG. 2).

Figure 3:
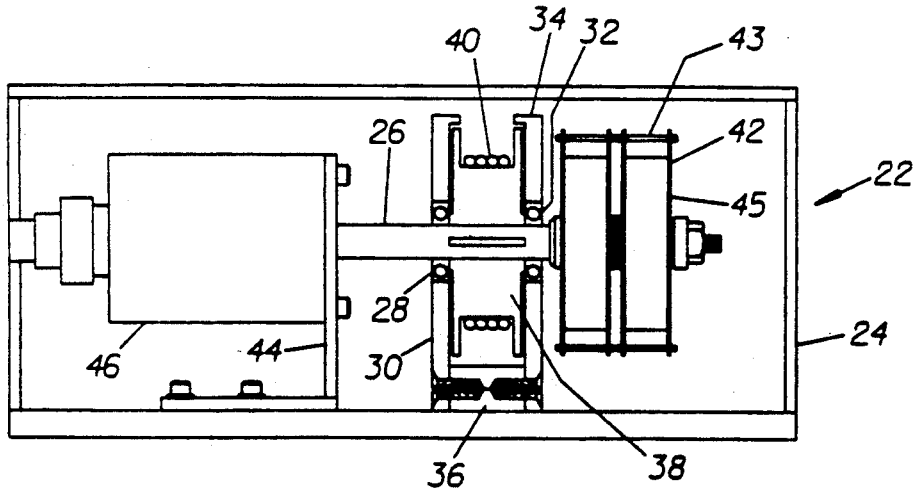
FIG. 3 is an illustration of the separation measurement device.

Attention is now directed to FIG. 3 which illustrates the miner advance sensor 22 contained within housing 24 mounted to the miner (see FIGS. 1 and 2). A shaft 26 is carried in bearing 28 in inboard mounting plate 30 and bearing 32 in outboard mounting plate 34. The plates 30 and 34 are mounted to base 36. A spool 38 is keyed to shaft 26 and carries a flexible cable 40. Spring reels 42 are carried on the shaft 26 and maintain the cable 40 taut as it is wound and unwound from the spool 38. Studs 43 extend from plate 34 through the flanges 45 of the reels 42 to maintain the reel housing stationary. The reel springs (not shown) are secured to the shaft 26. A bracket 44 supports an encoder 46 carried on shaft 26. The free end 48 of the cable 40 is attached to the conveyor and as the miner advances the output from the encoder is calibrated to represent the separation between the machine (as will become more apparent hereinafter).

Figure 4:
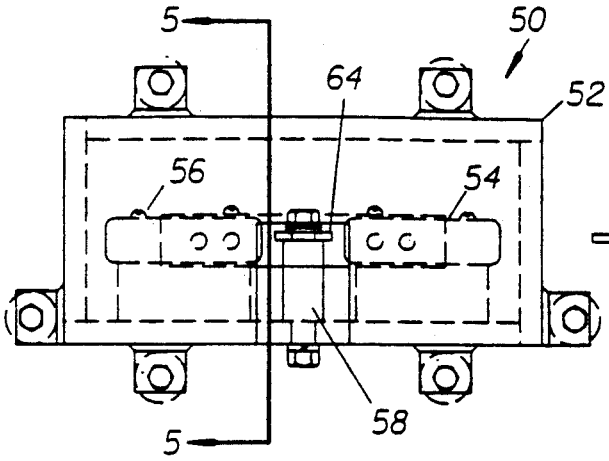
FIG. 4 is a front elevational view of the steering control.
Figure 5:
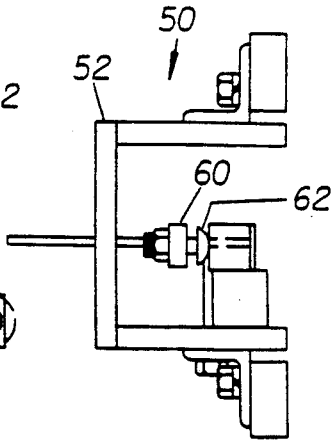
FIG. 5 is a side view of the steering control taken along the line 5—5 in FIG. 4; and, FIG. 6 is a schematic diagram of the separation measurement and steering control system.

Reference is now made to FIGS. 4 and 5 which illustrate the control sensor 50 for the steering on the tramming conveyor. The sensor housing 52 is bolted to the input steering end 20 of the conveyor and carries microswitches 54, 56. Pivot pin 58 supports cross arm 60 carrying microswitch actuator buttons 62. With the free end of cable 40 attached to extension 64 of cross arms 60, as the conveyor becomes misaligned to the right or left of the miner, the cable 40 pivots cross arm 60 to activate either microswitch 54 or 56 to input the steering assembly to make the correction (as will become apparent hereinafter).

Figure 6:
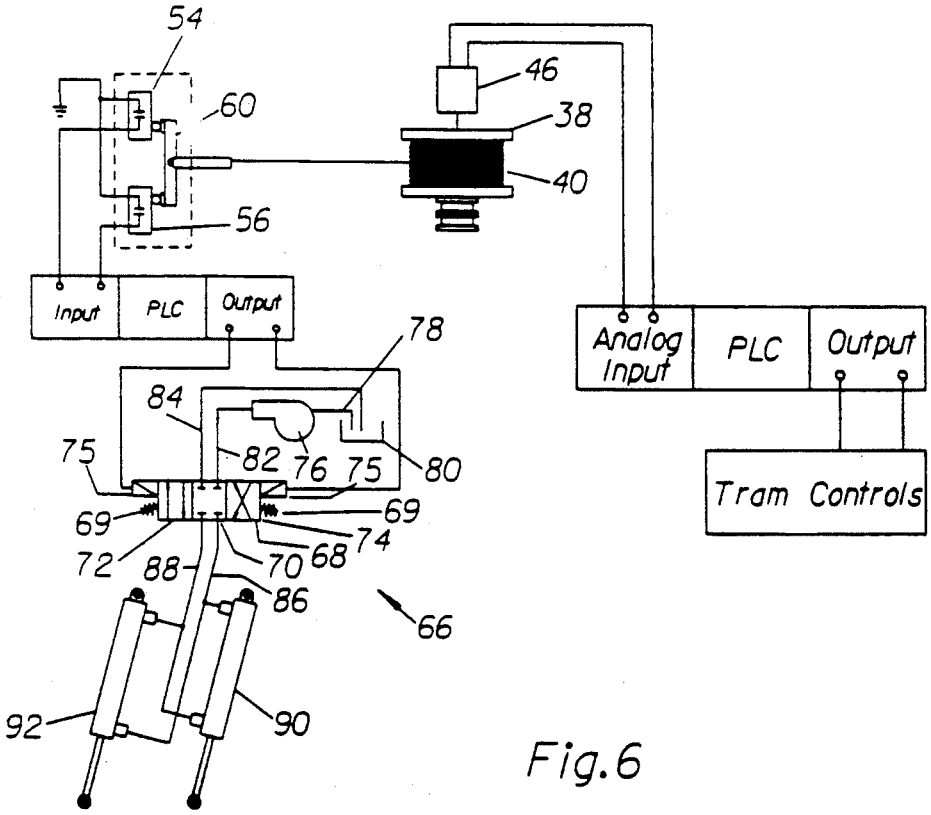

FIG. 6 illustrates a schematic of the system. The output from the encoder passes to the analog input of the programmable logic controller (PLC) which has an output to the tramming conveyor controls so that the tramming conveyor move-up automatically occurs to maintain the proper relationship between the miner and conveyor.

The steering system 66 for the input end of the conveyor comprises a hydraulic valve 68 which contains a neutral position 70, a first position 72 and a second position 74. A hydraulic pump 76 is coupled through line 78 to a sump 80. The output of pump 76 is coupled through line 82 to the valve 68. A return line 84 passes from the valve 68 to the sump 80. Springs 69 maintain the value 68 in a neutral position. The valve 68 is a standard valve having a central neutral position, a straight through position 74 and a reverse position 72. The valve 68 is operated by solenoids 75. It is apparent, depending on the position of the valve with respect to lines 82 and 84, the lines 86, 88 to the steering cylinders 90, 92 will be charged or discharged to cause the input end of the conveyor to be driven to the right, left or straight ahead.

As previously mentioned angular disparity of the conveyor will pivot cross arm 60 and operate either of the microswitches 54, 56 which input a programmable logic controller (PLC), the output from which will position the valve 68 and operate the steering cylinders 90, 92.

This invention is disclosed in relation to measuring the spacing of a conveyor from a miner and maintaining alignment of the conveyor with the miner however, it should be apparent that it can be applied to control displacement of two machines which are not mechanically linked and in full three dimensional spaced relation. Further, this closed loop control technique has the ability to measure separation and angular displacement in an environment with high dust concentrations in the air.

We claim:

1. Apparatus for measuring the separation between a driven self propelled leading machine and a steerable driven self propelled trailing machine and operable to control the angular displacement between the machines comprising the combination of:

a. drive means for the trailing machine;

b. automatic control means for said drive means;

c. steering means for the trailing machine;

d. automatic control means for said steering means;

e. said apparatus including a first means having flexible means carried on one machine and attached to the other machine, said first means being responsive to a change in separation between the machines to activate said automatic control means for said drive means; and f. said apparatus including second means operable by said flexible means in response to a change in angular displacement between the machines to activate said automatic control means for said steering means.

2. The apparatus of claim 1 wherein said first means includes an encoder having an output to a programmable logic controller inputting said drive means automatic controls.

3. The apparatus of claim 1 wherein said second means includes limit switches having outputs to a programmable logic controller inputting said steering means automatic controls.

4. The apparatus of claim 3 wherein said second means includes a pivotally mounted cross bar attached to said flexible means and operable to activate said limit switches in response to the angular disposition of said flexible means to said trailing machine.

5. The apparatus of claim 1 wherein said first means includes a spring controlled reel carrying said flexible means.

6. The apparatus of claim 1 wherein said leading machine is a continuous miner and said trailing machine is a tramming conveyor.

7. The method of maintaining a predesired disposition between a driven self propelled leading machine and a driven steerable self propelled trailing machine comprising the combined steps of:

a. measuring the separation between the machines;

b. automatically controlling the spacing of the driven trailing machine from the leading machine in response to the measured separation between the machines by activating the drive of the trailing machine at a given measured separation;

c. measuring the angular disposition of the machines with respect to one another; and, d. automatically controlling the angular displacement of the driven trailing machine in response to the angular disposition by activating the steering of the trailing machine at a given angular disposition.

* * * * *